US005768901A

United States Patent [19]

Dormer et al.

[11] Patent Number: 5,768,901

[45] Date of Patent: Jun. 23, 1998

[54] REFRIGERATING SYSTEM EMPLOYING A COMPRESSOR FOR SINGLE OR MULTI-STAGE OPERATION WITH CAPACITY CONTROL

[75] Inventors: Michael J. Dormer, Fabius; Bruce A. Fraser, Manlius, both of N.Y.

[73] Assignee: Carrier Corporation, Syracuse, N.Y.

[21] Appl. No.: 758,837

[22] Filed: Dec. 2, 1996

[51] Int. Cl.[6] ..... F25B 7/00; F04B 3/00

[52] U.S. Cl. ..... 62/175; 62/228.5; 417/248

[58] Field of Search ..... 62/175, 510, 228.5; 417/248

[56] References Cited

U.S. PATENT DOCUMENTS

| | | | |
|---|---|---|---|
| 4,938,029 | 7/1990 | Shaw | 62/117 |
| 5,016,447 | 5/1991 | Lane et al. | 62/470 |
| 5,062,274 | 11/1991 | Shaw | 62/117 |
| 5,577,390 | 11/1996 | Kaido et al. | 62/510 X |
| 5,626,027 | 5/1997 | Dormer et al. | 62/175 |

FOREIGN PATENT DOCUMENTS 53-133257 of 0000 Japan .

*Primary Examiner*—William E. Wayner

[57] ABSTRACT

A compressor having plural banks of cylinders can be operated multi-stage, single stage, plural parallel single stages and, when multi-stage, with or without an economizer. One of the low stage banks of cylinders can be unloaded to reduce the first stage output during multi-stage operation or to permit operation of a single stage when the second stage is bypassed.

5 Claims, 2 Drawing Sheets

REFRIGERATING SYSTEM EMPLOYING A COMPRESSOR FOR SINGLE OR MULTI-STAGE OPERATION WITH CAPACITY CONTROL

BACKGROUND OF THE INVENTION

Transport refrigeration can have a load requiring a temperature of −20° F. in the case of ice cream, 0° F. in the case of some frozen foods and 40° F. in the case of flowers and fresh fruit and vegetables. A trailer may also have more than one compartment with loads having different temperature requirements. In the case of some cargo such as fruit, vegetables and flowers, tight temperature control is necessary to avoid premature ripening or blooming. Additionally, the ambient temperatures encountered may range from −20° F., or below, to 110° F., or more. Because of the wide range of ambient temperatures that can be encountered on a single trip as well as the widely varying load temperature requirements, there can be a wide range in refrigeration capacity requirements. Multi-stage compressors are desired for transport refrigeration applications because they offer improved refrigerating capacity over traditional single-stage compressors for a modest cost premium. Currently available multi-stage compressor technology is difficult for the end user to apply because it requires a substantial number of external valves and pipes and has many application limitations that are necessary for the compressors to operate reliably. Japanese reference 53-133,257 discloses a multi-compressor arrangement. Commonly assigned U.S. Pat. No. 5,577,390 relates to multi-stage compressor operation and commonly assigned, now U.S. Pat. No. 5,626,027, relates to capacity control in a multi-stage compressor. Commonly assigned U.S. Pat. Nos. 4,938,029, 4,986,084 and 5,062,274 disclose reduced capacity operation responsive to load requirements while U.S. Pat. No. 5,016,447 discloses a two-stage compressor with interstage cooling. In reciprocating refrigeration compressors having multiple stages of compression, the intermediate pressure gas can be routed through the crankcase sump. Utilizing this approach for low temperature applications works quite well to increase the efficiency, however, in medium and high temperature applications several complications arise. Higher crankcase pressures produce a lower effective oil viscosity, increased thrust washer loads, and increased bearing loads.

SUMMARY OF THE INVENTION

A compressor having plural banks of cylinders can be operated multi-stage during low temperature operation and with a single stage or plural parallel single stages for medium and high temperature operation. Additionally, economizer operation can be employed when the compressor is in two-stage operation. Switching between single stage and multi-stage operation is under the control of a microprocessor in response to the sensed suction or crankcase sump pressure or to the box temperature in the case of load pulldown. Multi-stage operation provides increased capacity through the use of an economizer and lower pressure differences across each stage. Reduced capacity operation can be achieved by bypassing the first stage back to suction, by employing suction cutoff in the first stage, by bypassing the entire first stage, or by bypassing the high stage.

Assuming a six cylinder compressor defining three banks of two cylinders, the two outer or end banks would be designated as low stage banks. One of the low stage banks (LS-1) is equipped with a cylinder head configuration allowing the introduction of economizer gas into the discharge side of the cylinder head. The other low stage bank (LS-2) would be equipped with a standard suction cutoff unloader head. The center bank of the compressor would be designated as the high stage (HS) and is equipped with a cylinder head that allows the discharge gas from LS-2 to cross over to the suction side of HS internal to HS. A valve plate that blocks the flow of suction gas from the crankcase into the suction side of HS is utilized.

The present invention simplifies the application and control of a multi-stage compressor by routing the suction gas directly into the crankcase and internalizing the routing of the mid-stage gas. The only piping connections to the compressor would be the traditional suction and discharge connections and an additional connection for introducing economizer gas. The only additional system components required, as compared to a normal single stage system, would be an economizer, an economizer expansion valve, an economizer liquid line solenoid valve and bypass line valve (s).

Six steps of capacity control are available with the compressor and system design of the present invention. The steps are: single stage with two cylinders/one bank, LS-1, loaded; single stage with both LS-1 and LS-2 loaded; modified multi-stage operation with the two cylinders of one low stage bank, LS-1, pumping into the high stage bank HS, with and without the economizer being active; and traditional multi-stage operation with LS-1 and LS-2 pumping into HS with and without the economizer being active.

It is an object of this invention to provide a simplified multi-stage compressor design permitting suction gas to be routed through the crankcase.

It is another object of this invention to simplify the design and application of a multi-stage compressor for use in transport and/or stationary/commercial refrigeration systems.

It is a further object of this invention to provide a compressor which is operable multi-staged or single staged with single stage operation being a single stage or plural, parallel single stages. These objects, and others as will become apparent hereinafter, are accomplished by the present invention.

Basically, the suction or crankcase sump pressure and/or the box or zone temperature is sensed and, responsive thereto, the compressor is operated in either a multi-stage or single stage mode. Single stage operation may be as plural banks in parallel or by unloading either the first stage or second stage in multi-stage operation. Economizer operation may be employed in multi-stage operation.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
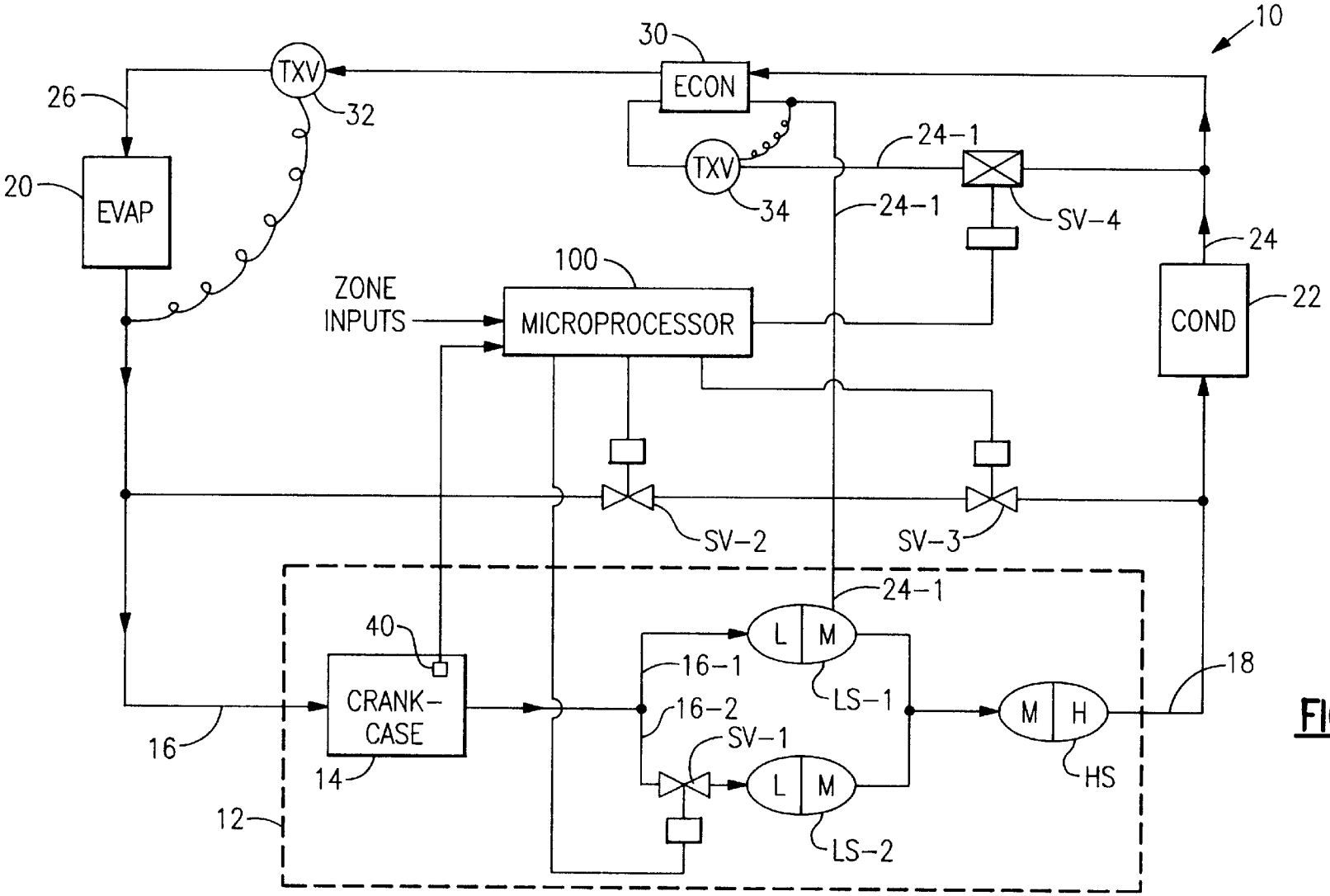
FIG. 1 is a schematic representation of a refrigeration system employing the compressor of the present invention.

Microprocessor 100 exerts overall control in the refrigeration system 10 of FIG. 1. Microprocessor 100 receives zone inputs indicating cooling requirements and, responsive thereto, starts and/or engages the internal combustion engine (not illustrated) driving compressor 12 in the case of a transport refrigeration system and provides power to the motor driving compressor 12 in the case of a stationary/commercial refrigeration system. Pressure sensor 40 senses the suction pressure in crankcase 14 which is a primary indicator of the operation of compressor 12 and which indicates the need to load compressor 12 when the sensed pressure is above a predetermined set point. Responsive to the pressure sensed by pressure sensor 40 and to the zone inputs, microprocessor 100 controls the capacity of compressor 12 and thereby system 10 by controlling solenoid valves SV-1 through SV-4. SV-1 is normally open and SV-2 through SV-4 are normally closed. Only one of valves SV-2 through SV-4 can be open at any time. Valves SV-2 and SV-3 and the lines in which they are located can be considered as redundant or alternative and, normally, only one would be present in a system.

Pistons (not illustrated) are reciprocatably driven by the motor (not illustrated) through a crankshaft (not illustrated). The crankshaft is located in crankcase 14 which has an oil sump located at the bottom thereof. Compressor 12 has a suction line 16 and a discharge line 18 which are connected, respectively, to the evaporator 20 and condenser 22 of refrigeration system 10. Economizer 30 and thermal expansion device, TXV, 32 are serially located between condenser 22 and evaporator 20. Suction line 16 includes crankcase 14 and branches into line 16-1 which feeds the cylinders of the first low stage bank LS-1 and line 16-2 which contains suction cutoff valve SV-1 and feeds the cylinders of the second low stage bank LS-2. With SV-1 open, the first and second banks, LS-1 and LS-2, discharge hot, intermediate pressure refrigerant gas into plenum M which serves as the suction plenum for high stage HS. The hot high pressure gas discharged from high stage HS is supplied at discharge pressure, $P_D$, via discharge line 18 to condenser 22. In the condenser 22, the hot refrigerant gas gives up heat to the condenser air thereby cooling the compressed gas and changing the state of the refrigerant from a gas to a liquid. With solenoid valve SV-4 closed, liquid refrigerant flows from condenser 22 via liquid line 24 and inoperative economizer 30 to thermostatic expansion valve, TXV, 32. As the liquid refrigerant passes through the orifice of TXV 32, some of the liquid refrigerant vaporizes into a gas (flash gas). The mixture of liquid and gaseous refrigerant passes via line 26 to the evaporator 20. Heat is absorbed by the refrigerant from the air across the evaporator causing the balance of the liquid refrigerant to vaporize in the coil of the evaporator 20. The vaporized refrigerant at evaporator pressure, $P_{EVAP}$, then flows via suction line 16 and crankcase 14 to lines 16-1 and 16-2 feeding low stages LS-1 and LS-2, respectively, of compressor 12 to complete the fluid circuit.

By opening solenoid valve SV-4, microprocessor 100 diverts a portion of the liquid refrigerant from liquid line 24 into branch line 24-1 permitting flow through, and thereby enabling, economizer 30 under the control of TXV 34. With servo valve SV-4 and TXV 34 open, expanded refrigerant is supplied at economizer pressure, $P_{ECON}$, via line 24-1 to plenum M which represents the discharge plenum of banks LS-1 and LS-2 and the suction plenum of bank HS. With SV-1 and SV-4 open maximum capacity is achieved. Closing solenoid valve SV-1 and thereby unloading bank LS-2 by suction cutoff reduces the total capacity by reducing the system mass flow independent of whether there is economizer operation. With SV-4 closed, the economizer is disabled and reduced capacity two-stage operation is achieved. Further capacity reduction can be obtained by closing solenoid valve SV-1 and thereby unloading bank LS-2 by suction cutoff. Reduced single stage operation can be achieved by opening SV-2 to bypass the first stage so that bank HS is doing all of the pumping or by opening SV-3 to bypass the second stage. With SV-3 open both banks LS-1 and LS-2 can be pumping or LS-2 can be unloaded by closing SV-1. As noted above, SV-2 and SV-3 are generally alternative.

With SV-4 open and SV-1 closed, economized operation takes place with LS-1 pumping to HS. LS-2 is cutoff by the closing of SV-1. Unloading of LS-2 could also be achieved by hot gas bypass. Closing SV-4 disables the economized operation.

With SV-4 and SV-1 closed and SV-3 open, single stage operation takes place with LS-1 doing all of the work. If SV-1 is opened, parallel single stage operation takes place with both LS-1 and LS-2 working.

Figure 2:
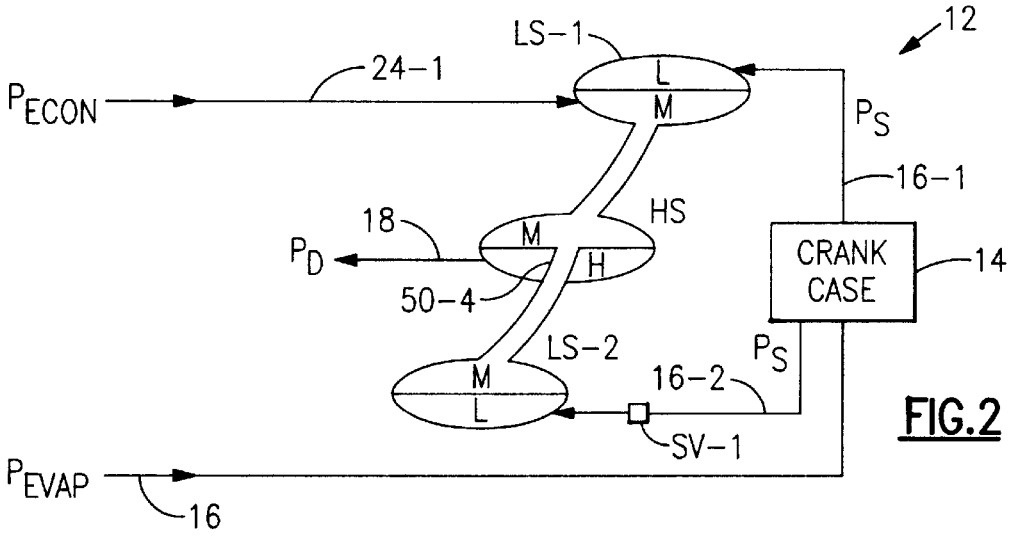
FIG. 2 is the basic compressor schematic.
Figure 4:
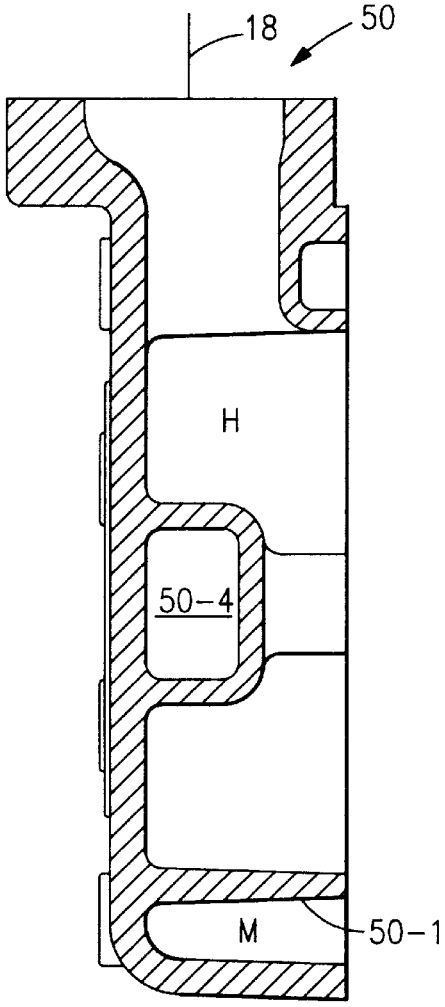
FIG. 4 is a sectional view taken along line 4—4 of FIG. 3.
Figure 3:
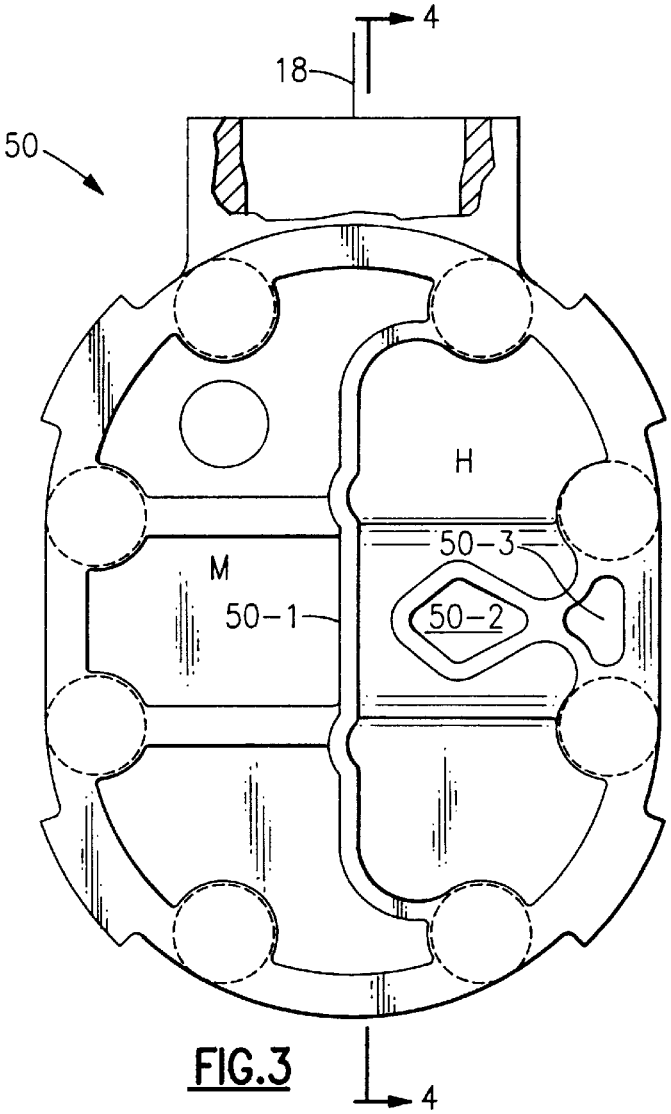
FIG. 3 is a view of the high side cylinder head.

As noted above, the present invention requires a modified cylinder head for high stage HS. Turning initially to FIG. 2, it will be noted that line 16-1 feeds suction chamber, L, of LS-1 and line 16-2 feeds suction chamber, L, of LS-2. Chambers M, which are in fluid communication with each other, represent the discharge chambers of LS-1 and LS-2 and the suction chamber of HS. Chamber M of LS-2 is in fluid communication with chamber M of HS via a passage 50-4 through chamber H in cylinder head 50 of HS. Turning now to FIGS. 3 and 4, it will be noted that partition 50-1 divides cylinder head 50 into chamber M and chamber H. The valve plate (not illustrated) coacts with cylinder head 50 to define chambers M and H of HS. To accommodate bolt locations and to provide the desired flow cross section, inlet ports 50-2 and 50-3 are provided. Ports 50-2 and 50-3 register with passage 50-4 and corresponding ports in the valve plate (not illustrated) of HS which provide fluid communication with chamber M of LS-2. Accordingly, a fluid path exists from chamber M of LS-2 to chamber M of HS serially including the ports in the valve plate of HS, ports 50-2 and 50-3, and passage 50-4 which leads to chamber M of HS. As shown schematically in FIG. 2, chamber M of LS-1 is connected via a fluid path with chamber M of HS but it does not require a special modification of cylinder head 50 such as passage 50-4.

Although a preferred embodiment of the present invention has been illustrated and described, other changes will occur to those skilled in the art. It is therefore intended that the scope of the present invention is to be limited only by the scope of the appended claims.

What is claimed is:

1. A refrigeration system having a closed circuit serially including a multi-stage compressor, a condenser, an economizer, an expansion device and an evaporator, a branch line connected to said closed circuit intermediate said condenser and said economizer and having a flow path including a first valve, an expansion device, and said economizer and connected to said compressor at an interstage location, said system including a microprocessor for controlling said system responsive to zone and system inputs, said compressor comprising:

a first stage including at least two banks;

a second stage;

said banks of said first stage have discharge chambers and said second stage has a suction chamber;

said second stage has a discharge chamber and said discharge chambers of said first stage and said suction chamber of said second stage are fluidly connected via a flow path which extends through said discharge chamber of said second stage;

means for unloading one of said banks of said first stage;

means for unloading one of said first and second stages;

said microprocessor controlling said first valve, said means for unloading one of said banks and said means for unloading one of said first and second stages whereby said system can be operated single stage, two stage with or without economized flow and with or without unloading of said one of said banks of said first stage.

2. The refrigeration system of claim 1 wherein said means for unloading one of said first and second stages unloads said first stage.

3. The refrigeration system of claim 2 wherein said means for unloading one of said first and second stages includes a second valve.

4. The refrigeration system of claim 1 wherein said means for unloading one of said first and second stages unloads said second stage.

5. A refrigeration system having a closed circuit serially including a multi-stage compressor, a condenser, an economizer, an expansion device and an evaporator, a branch line connected to said closed circuit intermediate said condenser and said economizer and having a flow path including a first valve, an expansion device, and said economizer and connected to said compressor at an interstage location, said system including a microprocessor for controlling said system responsive to zone and system inputs, said compressor comprising:

a first stage including at least two banks;

a second stage;

means for unloading one of said banks of said first stage;

means for unloading said second stage;

said microprocessor controlling said first valve, said means for unloading one of said banks and said means for unloading said second stage whereby said system can be operated single stage, two stage with or without economized flow and with or without unloading of said one of said banks of said first stage.

* * * * *